US005172493A

United States Patent [19]

Diaz

[11] Patent Number: 5,172,493

[45] Date of Patent: Dec. 22, 1992

[54] PROTECTIVE COVER FOR SHOES, BOOTS AND THE LIKE

[75] Inventor: Vincent Diaz, Hanover, Pa.

[73] Assignee: AT & S Specialties, Inc., Baltimore, Md.

[21] Appl. No.: 746,054

[22] Filed: Aug. 12, 1991

Related U.S. Application Data

[63] Continuation of Ser. No. 445,788, Nov. 29, 1989, abandoned.

[51] Int. Cl.[5] ..... A41D 17/00

[52] U.S. Cl. ..... 36/2 R; 36/1.5

[58] Field of Search ..... 36/2 R, 1.5, 7.3, 7.1, 36/9

[56] References Cited

U.S. PATENT DOCUMENTS

| | | | |
|---|---|---|---|
| 48,897 | 7/1865 | Blodgett . | |
| D. 60,684 | 3/1922 | Jenkins . | |
| 155,968 | 10/1874 | Owens . | |
| D. 160,743 | 10/1950 | Richardson . | |
| D. 169,889 | 6/1953 | Bollenbach . | |
| 230,498 | 7/1880 | Riese . | |
| D. 288,382 | 2/1987 | Birchwood | D2/314 |
| D. 306,921 | 3/1990 | Pettinelli . | |
| 540,889 | 11/1895 | Allen . | |
| 672,535 | 4/1901 | Lundgard | 36/2 R |
| 951,986 | 3/1910 | Daniel . | |
| 1,032,643 | 7/1912 | Allsopp . | |
| 1,132,835 | 3/1915 | Dehler . | |
| 1,463,357 | 7/1923 | Brown . | |
| 1,606,862 | 11/1928 | Zenishek . | |
| 1,610,378 | 12/1928 | Hogan . | |
| 1,709,541 | 4/1929 | Rauh . | |
| 1,877,182 | 7/1929 | Konecke | 36/7.1 R |
| 2,078,550 | 4/1937 | Wiesenfeld | 36/2 R |
| 2,099,476 | 11/1937 | Glowka | 36/2 R |
| 2,135,361 | 6/1939 | Ford et al. | 36/7.3 X |
| 2,446,158 | 7/1948 | Miller et al. . | |
| 2,657,477 | 11/1953 | Winslow . | |
| 2,757,460 | 8/1956 | Bufis | 36/2 |
| 2,872,745 | 2/1959 | Finegan | 36/2 |
| 2,902,779 | 9/1959 | Cook | 36/2 |
| 2,945,308 | 7/1960 | Pence | 36/2 |
| 3,003,261 | 10/1961 | Graham et al. | 36/2 R |
| 3,128,565 | 4/1964 | Graham et al. | 36/2 |
| 3,271,888 | 9/1966 | Graham et al. . | |
| 4,503,566 | 3/1985 | Wheeler | 2/22 |
| 4,526,828 | 7/1985 | Fogt et al. | 36/2 R X |
| 4,649,656 | 3/1987 | Cox et al. | 36/9 R X |
| 4,665,633 | 5/1987 | Edgerton | 36/2 R |
| 4,713,895 | 12/1987 | Vallieres | 36/1.5 |

FOREIGN PATENT DOCUMENTS

| | | | |
|---|---|---|---|
| 0329621 | 8/1989 | European Pat. Off. | 36/2 R |
| 0026964 | 12/1953 | Finland | 36/2 R |
| 0636475 | 4/1928 | France | 36/2 R |
| 1405458 | 5/1965 | France | 36/2 R |
| 0442189 | 1/1968 | Switzerland | 36/2 R |
| 0005151 | of 1896 | United Kingdom | 36/2 R |
| 0004084 | of 1904 | United Kingdom | 36/2 R |
| 0179115 | 5/1922 | United Kingdom | 36/2 R |
| 0730967 | 6/1955 | United Kingdom | 36/2 R |

OTHER PUBLICATIONS

U.S. Department of Agriculture, Forest Service, Specification 6170-4D, Jan. 1989, Chaps, Chainsaw.

*Primary Examiner*—Paul T. Sewell
*Assistant Examiner*—Ted Kavanaugh
*Attorney, Agent, or Firm*—Leonard Bloom

[57] ABSTRACT

A flexible protective cover for boots, shoes and the like having a lining of woven and non-woven aramid fabric between an inner layer and an outer layer of durable fabric. The protective cover is folded to conform to the instep of the shoe and extend to the ankle. A strap and fasteners are attached to the cover to permit the cover to be secured over the shoe in a rapid and easy manner. The protective cover is fabricated by cutting patterns for the outer and inner layers and for aramid linings. The components are sewn together such that the aramid linings are joined so that a sharp edge or blade is prevented from penetrating the cover. A bias binding is sewn about the joined patterns. The straps and fasteners are sewn to the joined patterns.

17 Claims, 8 Drawing Sheets

PROTECTIVE COVER FOR SHOES, BOOTS AND THE LIKE

CROSS-REFERENCE TO RELATED APPLICATION

The present application is a continuation of Ser. No. 445,788 filed Nov. 29, 1989 for "Protective Cover for Shoes", abandoned, which is assigned to the same assignee as the present invention.

FIELD OF THE INVENTION

The present invention relates to a flexible protective cover for shoes, boots and the like and, more particularly, to a cover made of aramid fibers.

BACKGROUND OF THE INVENTION

The widespread use of chainsaws and similar high speed cutting devices, both commercially and individually, has resulted in many serious injuries to the users. The frequency and magnitude of these injuries have been a major concern to safety organizations, employers and insurance companies. Numerous protective and safety measures and devices have been proposed to protect the users of these devices.

Of interest to the present invention are the following:

| U.S. Pat. No. | Inventor(s) | Date of Issue |
|---|---|---|
| 2,757,460 | Bufis | 08/07/56 |
| 2,872,745 | Finegan | 02/10/59 |
| 2,902,779 | Cook | 09/08/59 |
| 2,945,308 | Pence | 07/19/60 |
| 3,003,261 | Graham et al | 10/10/61 |
| 3,128,565 | Graham et al | 04/14/64 |
| 4,503,566 | Wheeler | 03/12/85 |
| D 288,382 | Birchwood | 02/24/87 |
| 4,665,633 | Edgerton | 05/19/87. |

Bufis discloses a pants protector formed of a thin waterproof material adapted to be fitted over the lower portion of the trousers leg and the upper part of the shoe to protect the same against the elements.

Finegan discloses a spat-like protector of duckbill design having a cuff of pliable leather to wrap around the ankle and a foot covering portion of tough flexible leather. The device is to protect the wearer from the shock of falling objects and to guard against spills.

Two piece rigid leggings constructed of resinous fiber reinforced plastic which encircle the leg from the knee to the vamp of the shoe are disclosed by Cook.

Pence discloses a metal snake guard comprised of two contoured sides hinged by leather strips. The protector extends from the knee to the ankle.

Graham et al, in both references, disclose a hunting boot protector having two pieces; a foot covering member and a leg covering member attached to the foot covering member. The device is constructed of a fiber impregnated resin plastic.

Wheeler discloses a device to protect feet and legs against molten metal contact comprising a two-piece upper portion which wraps around a user's lower leg and a stiff flare portion to cover the top of the user's shoe.

Birchwood discloses a flexible shoe/boot heel protector.

Edgerton discloses a shoe top cover formed of a single thickness of flexible fabric to protect the shoe upper from paint or plastic dripping.

None of these references are directed toward providing protection to users of high speed cutting tools and which also permit the user to wear the protective device while engaged in normal walking and working situations. Even leather boots and so-called "safety shoes" do not provide protection against a high speed chainsaw.

The applicant is aware of one type of protective device designed for use with chainsaws which is a protective chaps type of garment. The chaps are more fully described in Specification 6170-4D, January 1989 for Chaps, Chainsaw, published by the U.S. Department of Agriculture, Forest Service which covers the requirements for nylon covered aramid chainsaw chaps. The chaps, which are intended for use by workers operating chainsaws, are cut resistant and provide protection for the legs and lower torso area. These chaps are widely used by employees in the lumber industry, but despite this use, there is still a disturbingly high incidence of serious injuries to the feet of employees caused by accidents with chainsaws.

Thus, there exists an urgent need to provide a protective device to cover the feet and ankles, including shoes and the like, of persons using high speed cutting devices such as chainsaws.

SUMMARY OF THE INVENTION

Accordingly, it is a primary object of the present invention to protect the user of high speed cutting devices such as chainsaws from serious injury by providing a cover for feet, ankles, shoes and the like.

It is a further object of the present invention to provide a protective cover for shoes and the like which is simple and easy to secure over the shoe, which will remain in place, and which may be worn comfortably for extended periods.

It is yet a further object of the present invention to provide a protective cover for shoes and the like which is cut and abrasive resistant.

It is another object of the present invention to provide a method of manufacture for a protective covering for shoes and the like which is economical and conducive to mass production.

In accordance with the teachings of the present invention, there is disclosed a flexible protective cover for use with chainsaws and the like to protect feet, ankles, shoes, boots and the like.

The shoe has an arch, a back, a sole, an outer side, an inner side and an instep. The cover is a multiple layer fabric body which, when folded, is contoured as a curve to conform to the instep of the shoe and extend to the ankle. The folded body extends from the instep of the shoe, on both the outer side and the inner side of the shoe, downwardly to the sole of the shoe and backwardly to the back of the shoe. Releasable means are provided for securing the folded body around the arch of the shoe. Releasable means are also provided for securing the folded body around the back of the shoe. The multiple layer fabric comprises at least a first, outer layer and a second, inner layer. An aramid lining is therebetween such that the cover is lightweight and pliable and may be worn comfortably for extended periods. When so used, the cover is cut and abrasion resistant.

The multiple layer fabric body comprises at least a first portion and a second portion joined together. The first portion and the second portion may be sewn together. The multiple layer fabric body when folded, further has a first side on the outer side of the shoe and a second side on the inner side of the shoe. Means for securing the folded body around the sole of the shoe include a strap connected to the first side of the fabric body. The strap has an end extending around the arch of the shoe and means are provided for releasably attaching the end of the strap to the second side of the fabric body.

A tab extends outwardly from the first side of the fabric body beyond the back of the shoe. Means are provided for connecting the tab to the second side of the fabric body around the back of the shoe such that the folded body is secured around the back of the shoe.

A protective cover for the foot of a person using a chainsaw or the like is disclosed, wherein the foot is covered by a shoe or boot having an instep, an arch, and a back portion. The protective cover has first and second sections which are substantially identical to one another. Each of the sections is substantially flat and has a lower edge, a rearward edge and a forward curved edge that is concave when viewed from beyond the protective cover. The first and second sections are joined together at their respective forward curved edges. The first and second sections are substantially flexible so that the cover may be easily and conveniently wrapped around the person's foot, such that the respective forward curved edges which are joined together will substantially conform to the instep of the person's shoe, and cover the ankle and the person. First cooperative fastening means are carried by the cooperative lower edges of the first and second sections, respectively, for detachably securing the first and second sections together around the arch of the person's foot. Second cooperative fastening means are carried by the respective rearward edges of the sections, respectively, for detachably securing the first and second sections together around the back of the person's foot, such that the cover fits the person's foot comfortably and does not interfere with the person's tasks. Each of the sections has a multiple ply construction including an outer layer, an inner layer, and a layer of an aramid lining secured between the inner and outer layers. The inner and outer layers are substantially tough and abrasion resistant, and the aramid lining is fully capable of stopping a chainsaw in the event the outer layer is cut by the saw.

The protective cover is fabricated by cutting a durable fabric into two patterns which are joined along respective concave edges to form a first portion. Two additional patterns are cut from the same fabric. Patterns are cut from woven aramid fabric and non-woven aramid fabric. The aramid patterns are placed in alternating non-woven/woven lining on the respective additional patterns and are joined together along respective concave edges to form a second portion. The method of joining is a seam sewn through the respective additional fabric patterns and the woven and non-woven aramid patterns. In this manner, the aramid linings on the additional fabric patterns are joined edge to edge such that a sharp edge or blade is prevented from penetrating the portion. The first portion is placed on the second portion such that the aramid linings are therebetween and the seams are substantially coincidental. The first and second portions are sewn together by two additional seams which are substantially parallel and adjacent to the seams which join the patterns. The additional seams are on opposite sides of the seam joining the patterns. The additional seams intercept the fabric selvage edges of the durable fabric, the selvage edges of the woven and non-woven aramid, the woven and non-woven aramid linings and the additional fabric. These seams further strengthen the joining of the several portions and further assure that a sharp blade is prevented from penetrating the joined patterns. A binding is sewn around the body which has been formed. Means such as a strap, tab, loop, and/or hook and loop fasteners are attached to the body such that when the body is folded, it may be worn on a shoe, boot or the like.

These and other objects of the present invention will become apparent from a reading of the following specification, taken in conjunction with the enclosed drawings.

BRIEF DESCRIPTION OF THE PREFERRED EMBODIMENTS

Figure 1B:
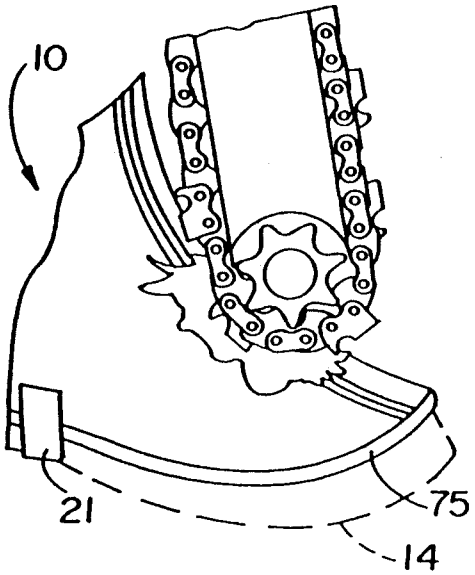
FIG. 1B is a perspective view, in enlarged scale, showing the aramid fabric jamming the teeth of chainsaw and providing protection to the wearer of the protective cover of the present invention.
Figure 1A:
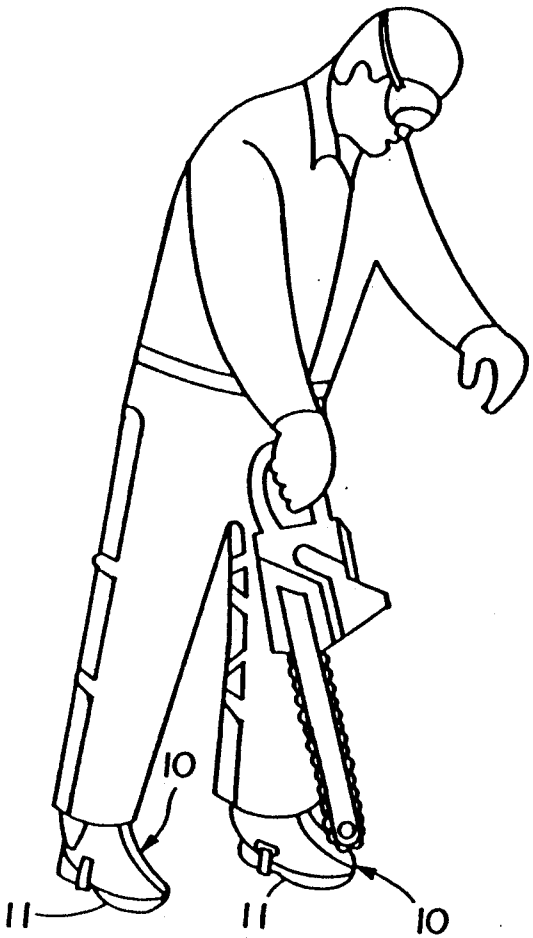
FIG. 1A is a perspective view of the operating chainsaw accidentally contacting the protective cover of the present invention.
Figure 1:
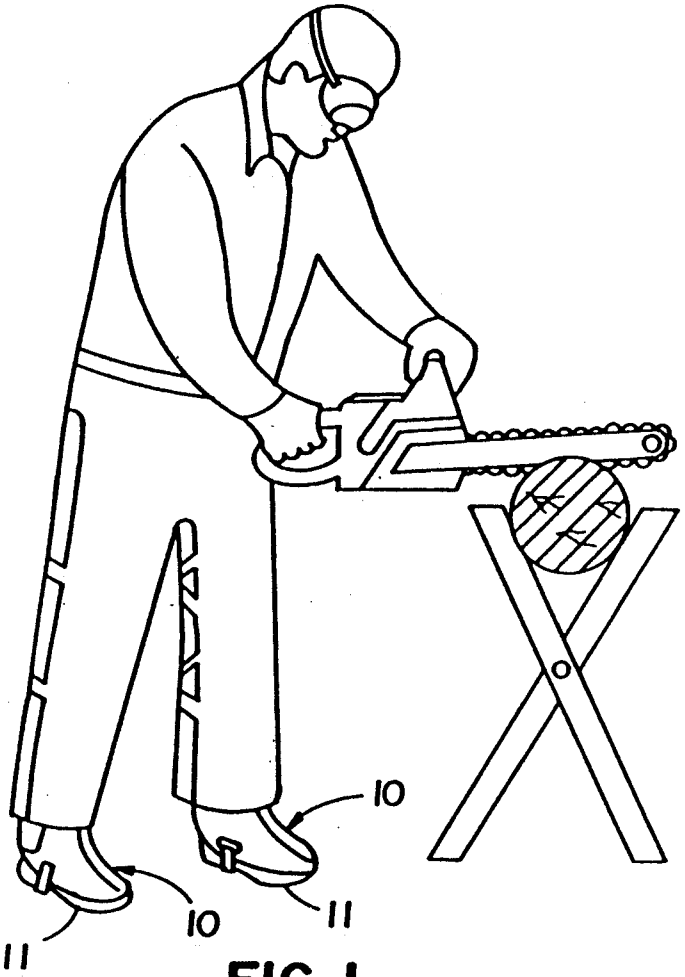
FIG. 1 is a perspective view of a user holding a chainsaw and wearing protective chaps and the protective cover for shoes of the present invention.

Referring to FIGS. 1-8 the protective cover 10 is shown as it is worn on a typical shoe or boot 11. The protective cover 10 is a multiple layer fabric body which is folded to be contoured as a curve to conform to the instep 15 of the shoe 11. When so folded, the protective cover 10 extends, in a gaiter-like manner, over the ankle of the wearer and extends from the instep of the shoe, on both the outer side and the inner side of the shoe, downwardly to the sole 14 of the shoe 11 and backwardly to the back 13 of the shoe 11. A strap 21 is attached to the first side of the cover 19 and is extended around the arch 12 of the shoe 11. FIGS. 1A and 1B show the use of the protective cover 10 in a typical accident in which a chainsaw contacts the protective cover 10. The teeth of the chainsaw are jammed by the aramid and the cutting action of the chainsaw is stopped.

Figure 3:
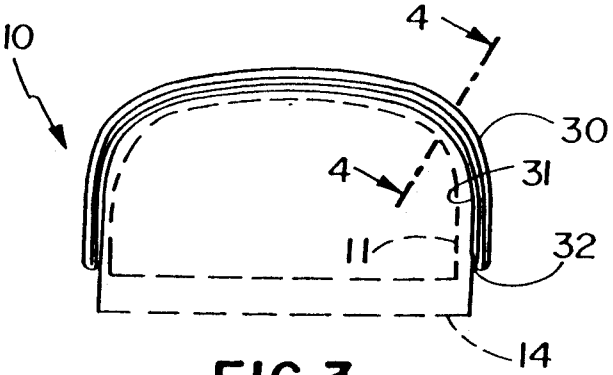
FIG. 3 is a cross-sectional view of the protective cover taken along lines 3—3 of FIG. 2.
Figure 4:
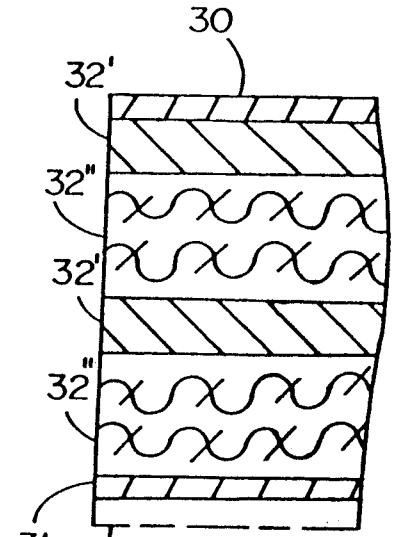
FIG. 4 is a cross-sectional view of the protective cover taken along lines 4—4 of FIG. 3.
Figure 2:
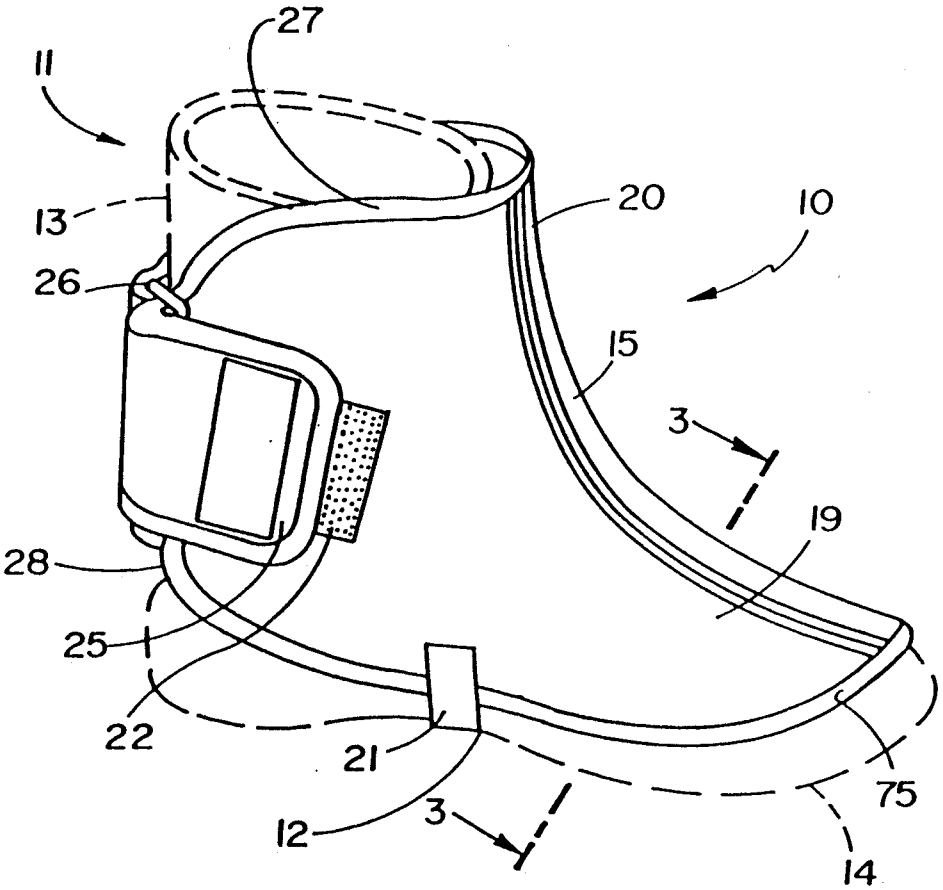
FIG. 2 is a perspective view of the protective cover of the present invention showing the means of wearing the cover on a boot.

As shown in FIG. 3, the protective cover 10 protects the entire upper surface of the shoe 11. FIG. 4 shows that the multiple layer body has an outer layer 30 and an inner layer 31 with an aramid fiber lining 32 therebetween. The outer layers 30, 31 may be nylon or other suitable fabric which is durable. Para-aramid fiber sold by E. I. Du Pont de Nemours & Co., Inc. under the registered trademark "Kevlar" has been used satisfactorily as the lining material. In a preferred embodiment, the aramid lining 32 comprises both woven 32′ and non-woven 32″ fabric. At least one layer of woven aramid 32′ is placed adjacent to at least one layer of non-woven aramid 32″. In an especially preferred embodiment two (2) woven aramid 32′ layers are in an alternating pattern with two (2) non-woven aramid 32″ layers.

Figures 5, 6, 7, 8:
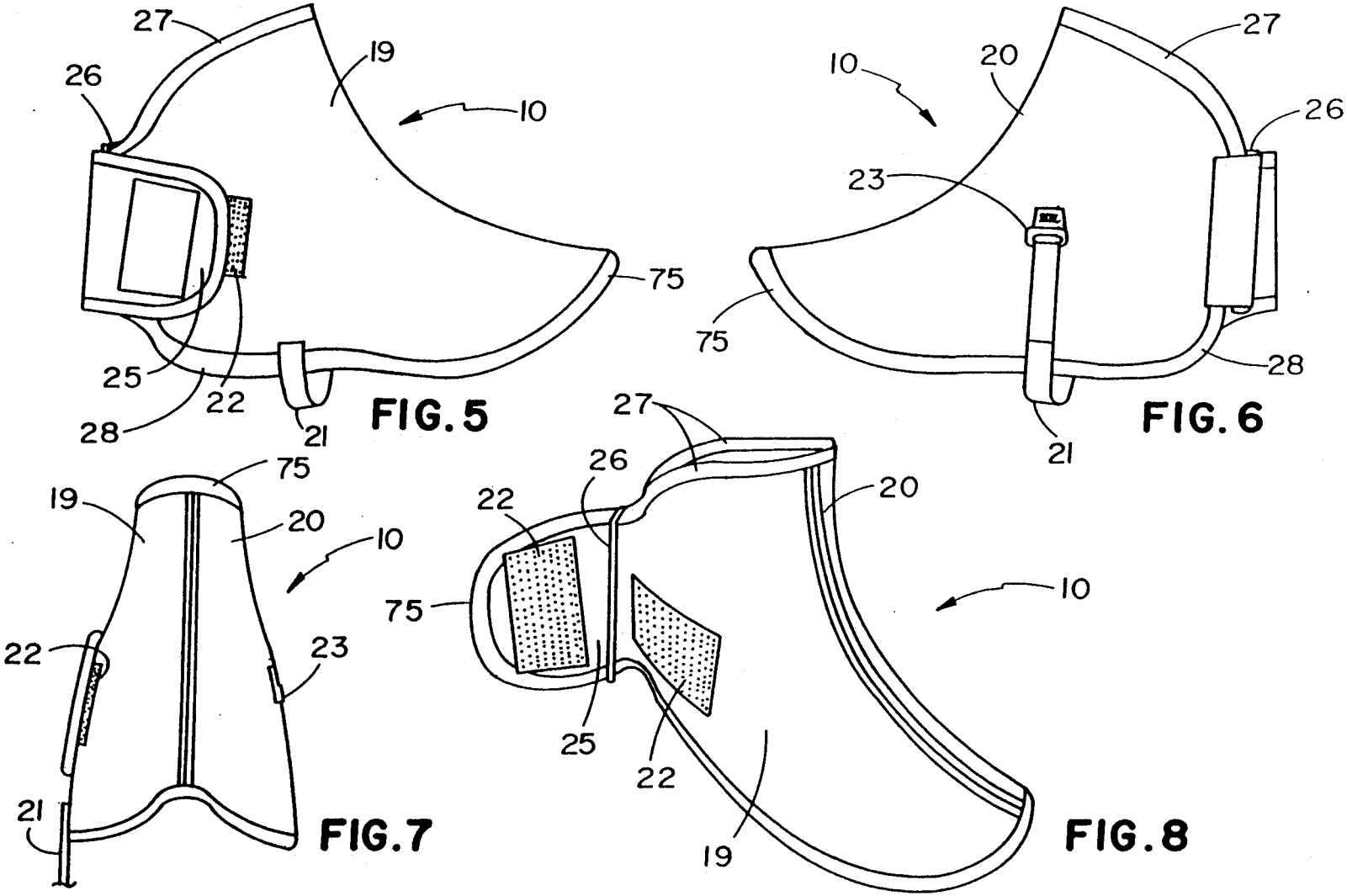
FIG. 5 is a right side elevational view of FIG. 2 showing the tab extending around the back of the boot to secure the cover and also showing the strap extending under the arch of the boot.
FIG. 6 is a left side elevational view of FIG. 2 showing the strap secured to the side of the protective cover and extending under the arch of the boot to secure the protective cover.
FIG. 7 is a front view of the protective cover of the present invention showing the strap secured to the side of the cover and extending from the side of the cover.
FIG. 8 is a perspective view of the protective cover of the present invention showing the tab drawn through the rigid loop such that the tab may be folded back to secure the cover around the back of the boot and be held in place by the hook and loop fasteners.

As seen in FIGS. 6-7, an eyelet 23 having an opening therein is attached to the second side of the cover 20. The end of the strap 21 is inserted through the opening in the eyelet 23 and folded back on itself and adjustably held thereon by hook and loop fasteners on the end of the strap and on the body of the strap. Alternately, the eyelet 23 may be omitted and the strap 21 may be fastened directly to the second side of the cover 20 by means of hook and loop fasteners, buckles, snap or other suitable fasteners. This means of securing the cover 10 around the arch 12 of the shoe 11 permits adjustment to accommodate shoes of varying sizes and also is a simple and rapid means for securing the cover 10 to the shoe 11. Further, by securing the cover 10 around the arch 12 of the shoe 11, the cover 10 conforms to the shoe 11 to provide the needed protection and also permits wearing of the cover 10 under all types of walking and working conditions.

Each side 19-20 of the protective cover 10 has a respective upper portion and a respective lower portion. As seen in FIGS. 2, 5, 6 and 8, the upper portion of each side 19, 20 curves downwardly toward the rear of the cover 10 and the lower portion of each side 19, 20 curves upwardly toward the rear of the cover 10.

The first side of the cover 19 has a tab 25 extending outwardly therefrom (FIGS. 2, 5, 6 and 8). The tab 25 further has a height which extends substantially between the upwardly curved portions and the downwardly curved portions of the respective sides 19, 20. When the cover 10 is folded and placed over the shoe 11, the tab 25 extends outwardly beyond the back of the shoe 13. The tab 25 is extended across the second opening 18 and is inserted into a rigid loop means 26 attached to the second side of the cover 20. The tab 25 is then returned approximately 180° to the first side of the cover 19, thereby closing the second opening 18 in the cover 10 and securing the cover 10 about the back 13 of the shoe 11. The tab 25 is secured to the first side of the cover 19, preferably by means of hook and loop fasteners 22. Alternately, a buckle, snap or other suitable fasteners could be used. Also, the tab may be a strap or other means and may be attached with suitable fasteners directly to the second side of the cover 20 rather than be returned to the first side of the cover 19. Persons skilled in the art will appreciate that alternate means may be used for securing the cover 10 around the back 13 of the shoe 11.

Figure 9:
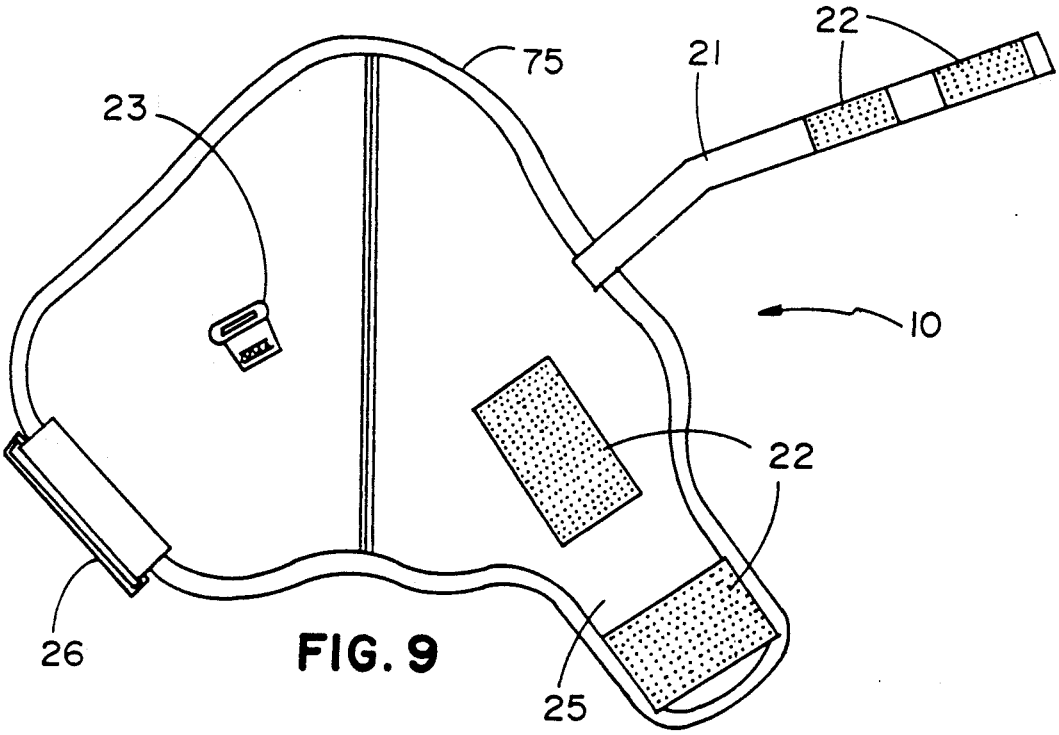
FIG. 9 is a top plan view of the protective cover of the present invention, wherein the cover has been laid open and flattened out showing the tab, the rigid loop, the strap and the hook and loop fasteners.
Figure 10:
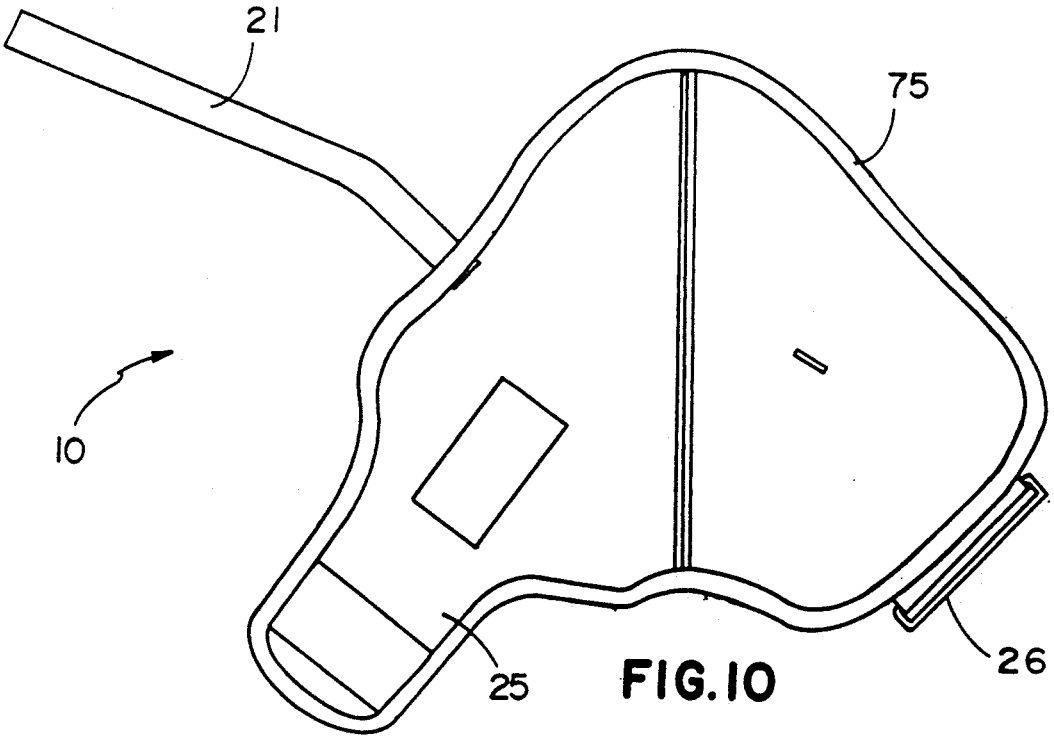
FIG. 10 is a bottom plan view of the protective cover of the present invention, wherein the cover has been laid open and flattened out showing the tab and the strap extending outwardly from the body.

As shown in FIGS. 9 and 10, the cover 10 is a body having a first portion and a second portion which are joined together. Preferably, the portions are sewn together.

Figure 11:
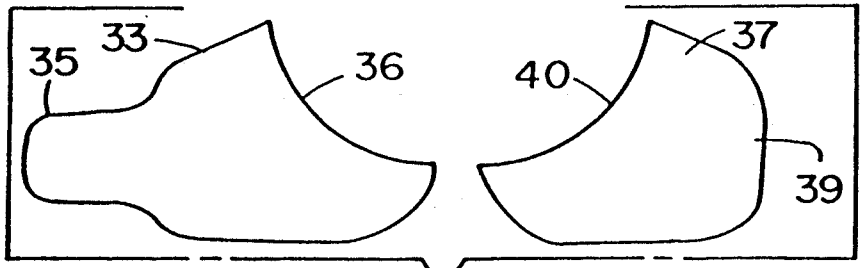
FIG. 11 is a top plan view showing the outside of the first section and the outside of the second section prior to joining.
Figure 14:
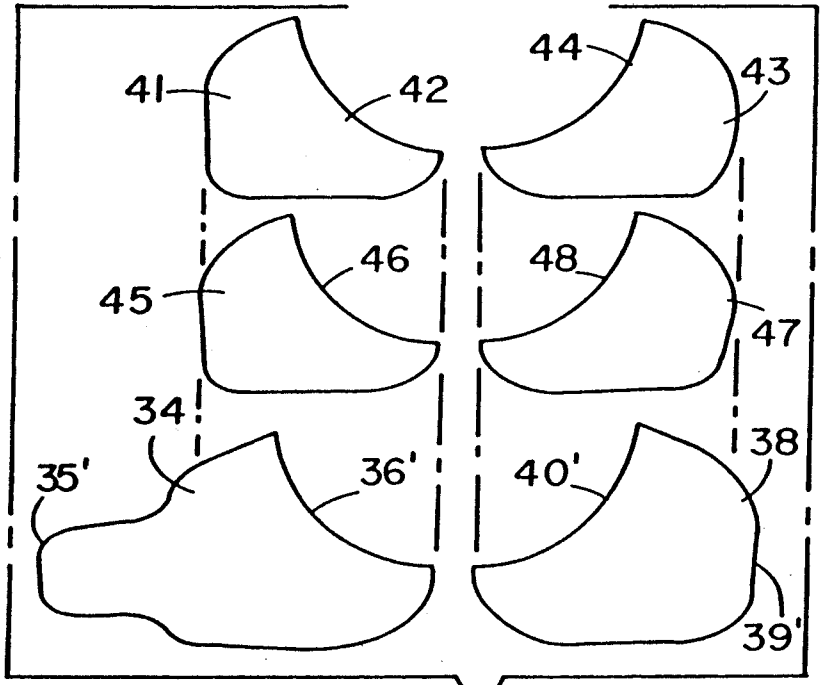
FIG. 14 is an exploded top plan view showing the inside of the first section, non-woven aramid lining and woven aramid lining to be placed thereon, and the inside of the second section, non-woven aramid lining and woven aramid lining to be placed thereon in position prior to joining of the components.

A method for fabricating a protective cover 10 for a shoe 11, boot and the like includes the steps of providing a sheet of fabric and cutting two patterns from the fabric sheet. An outside pattern 33 is cut for the first section of the shoe cover and an inside pattern 34 is cut for the first section of the shoe cover 10. Each pattern has a respective tab edge 35, 35′ and an opposite respective concave edge 36, 36′ (FIGS. 11 and 14). The fabric may be nylon or other material with sufficient durability. Two additional patterns are cut from the fabric sheet. An outside pattern 37 is cut for the second section of the shoe cover and an inside pattern 38 is cut for the second section of the shoe cover 10. Each pattern has a respective back edge 39, 39' and an opposite respective concave edge 40, 40'. A sheet of woven aramid fabric is provided. Referring to FIG. 14, at least one pattern 41 is cut from the woven aramid fabric to provide a lining for the first section of the shoe cover 10. Each pattern has a concave edge 42. At least one pattern 43 is cut from the woven aramid fabric to provide a lining for the second section of the shoe cover 10. Each pattern has a concave edge 44. A sheet of non-woven aramid fabric is provided. At least one pattern 45 is cut from the non-woven aramid fabric to provide additional lining for the first section of the shoe cover. Each pattern has a concave edge 46. At least one pattern 47 is cut from the non-woven aramid fabric to provide additional lining for the second section of the shoe cover. Each pattern has a concave edge 48.

Figure 13:
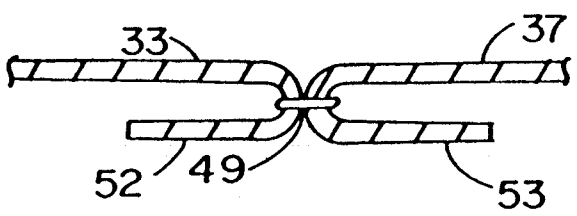
FIG. 13 is a cross-sectional view, enlarged for the sake of clarity, taken across the lines 13—13 of FIG. 12.
Figure 12A:
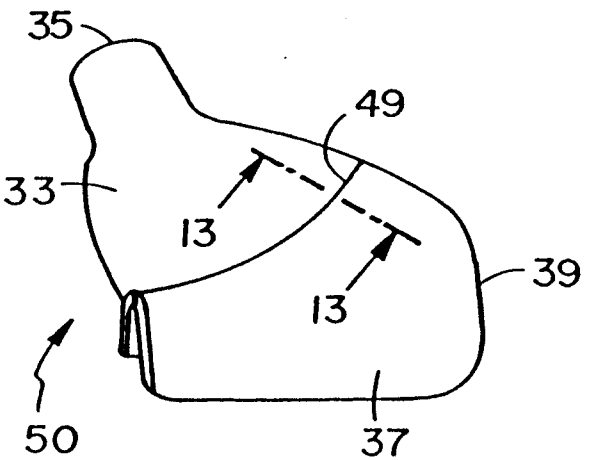
FIG. 12A is a perspective view showing the sections of FIG. 11 sewn together along their respective concave edges.
Figure 12:
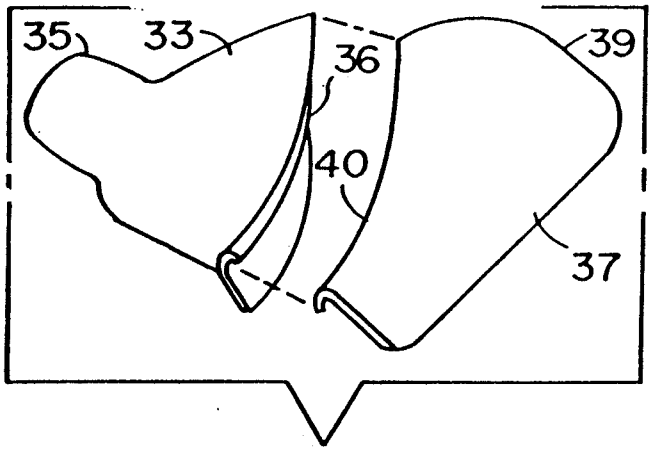
FIG. 12 is a perspective view showing the joining of the sections of FIG. 11 along their respective concave edges.

Referring to FIG. 12, the respective concave edge 36 of the outside of the first section 33 is butted with the respective concave edge 40 of the outside of the second section 37 and said concave edges 36, 40 are sewn together to form a seam 49. (FIG. 12A) When the sewn sections are opened and laid flat, a first portion 50 is formed having an upper surface and a lower surface. A selvage edge 52, 53 for each respective section is formed (FIG. 13), the selvage edges extending from the lower surface. The selvage edges 52, 53 are folded away from the seam such that each selvage edge 52, 53 is parallel to each respective section 33, 37.

As shown in FIG. 14, the pattern for the non-woven aramid fabric for the first section 45 and the pattern for the woven aramid fabric for the first section 41 are placed on the pattern for the fabric sheet for the inside of the first section 34 such that the respective concave edges 42, 46, 36' are substantially coincidental. The pattern for the non-woven aramid fabric for the second section 47 and the pattern for the woven aramid fabric for the second section 43 are placed on the pattern for the fabric sheet for the inside of the second section 38 such that the respective concave edges 48, 44, 40' are substantially coincidental.

Figure 15:
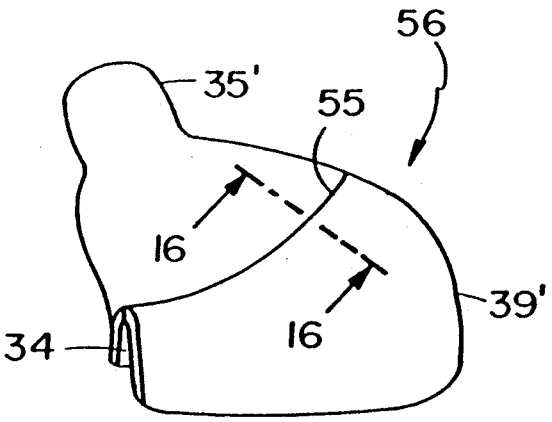
FIG. 15 is a perspective view showing the components of FIG. 14 sewn together along their respective concave edges.

Referring to FIG. 15 the respective concave edges of the inside of the first section 36 and the woven aramid lining 42 and the non-woven aramid lining 46 are butted with the respective concave edges of the inside of the second section 40' and the woven aramid lining 44 and the non-woven aramid lining 48 in a manner similar to that described above (and shown in FIGS. 12 and 12A). The concave edges 36', 42, 46, 40', 44, 48 are sewn together to form a seam 55 which extends through the woven aramid lining 41, the non-woven aramid lining 45, the inside of the first section of fabric 34, and through the inside of the second section of fabric 38, the non-woven aramid lining 47 and the woven aramid lining 43. When the sewn sections are opened and laid flat a second portion 56 is formed.

Figure 16:
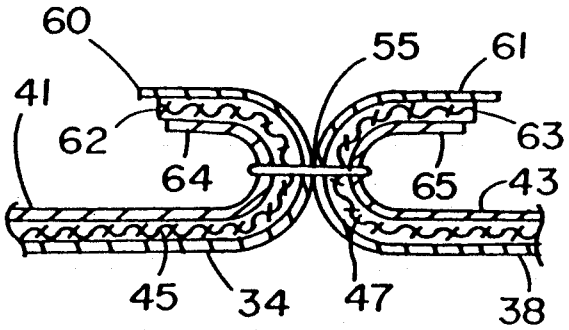
FIG. 16 is a cross-sectional view, enlarged for the sake of clarity, taken across the lines 16—16 of FIG. 15.

As shown in FIG. 16, a respective selvage edge 60, 62, 64, 61, 63 and 65 is formed on each of the inside of the first section 34, the non-woven aramid lining 45 and the woven aramid lining 41, the inside of the second section 38, the non-woven aramid lining 43 and the woven aramid lining 65. The respective selvage edges 60, 62, 64, 61, 63, 65 extend from the seam 55, the selvage edges being folded away from the seam 55 such that each selvage edges 60, 62 and 64 are parallel to the first section 34 and selvage edges 61, 63 and 65 are parallel to the second section 38.

Figure 17:
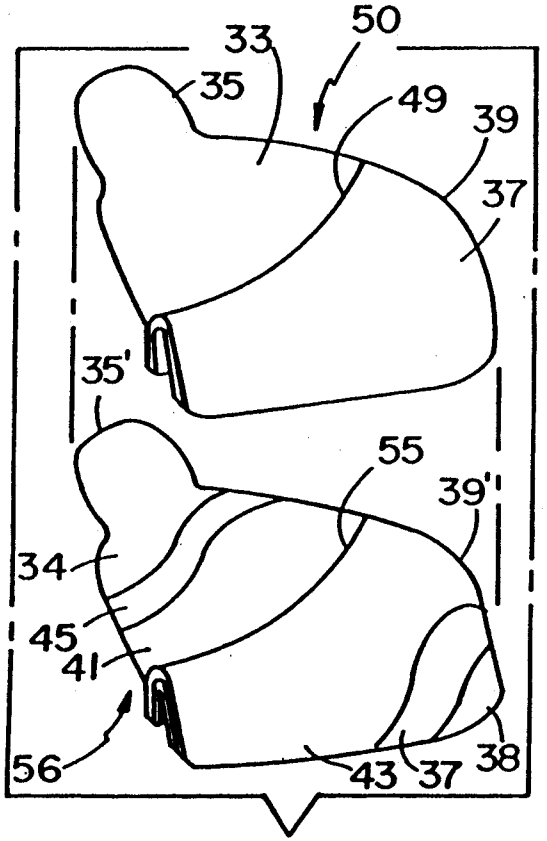
FIG. 17 is a perspective view showing the assembling of the joined outside sections of FIG. 12A with the joined inside sections of FIG. 15 and further showing a partial cut-away view to illustrate the layers comprising the body.

As shown in FIG. 17, the first portion 50 is placed adjacent to the second portion 56 such that the non-woven aramid lining 45, 47 and the woven aramid lining 41, 43 are disposed between the first portion 50 and the second portion 56, in a manner such that the seams 49, 55 of the sewn together sections are substantially coincidental. The tab edge of the inside of the first section 35' is substantially coincidental with the tab edge of the outside of the first section 35, and the back edge of the inside of the second section 39' is substantially coincidental with the back edge of the outside of the second section 39.

Figure 18:
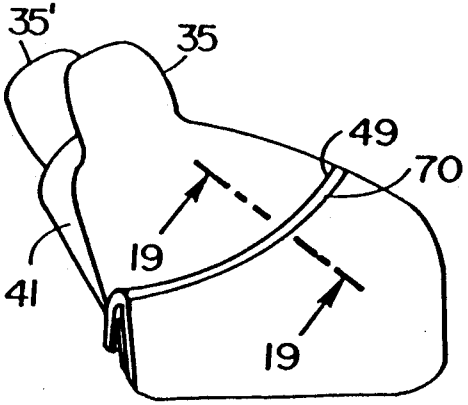
FIG. 18 is a perspective view showing the respective inside first section sewn together with the respective outside first section.

As shown in FIG. 18, the outside of the second section 37 of the first portion 50, is sewn to the inside of the second section 38 of the second portion 56 by forming a seam 70 substantially parallel and adjacent to the seams 49, 55 which form the respective first portion 50 and second portion 56.

Figure 19:
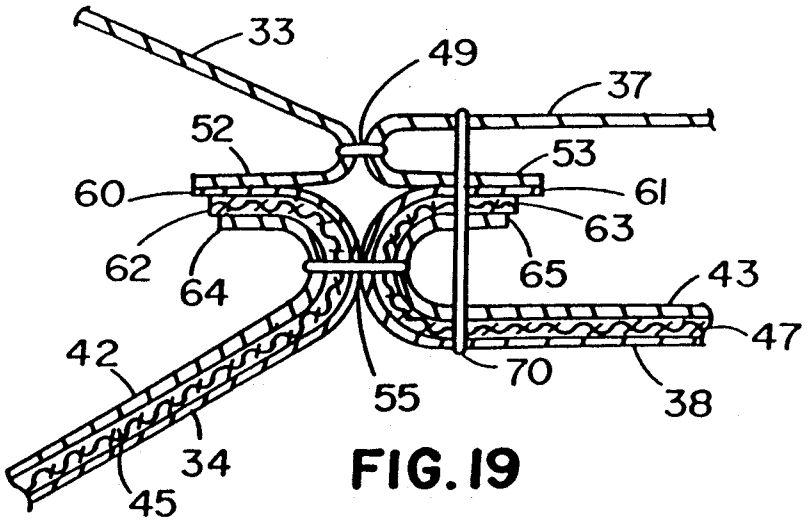
FIG. 19 is a cross-sectional view, enlarged for the sake of clarity, taken across the lines 19—19 of FIG. 18.

In this manner, (FIG. 19) the seam between the outside of the second section 37 (on the first portion 50) and the inside of the second section 38 (in the second portion 56) intercepts, in sequence, the outside of the second section 37, the selvage edge of the outside of the second section 53, the selvage edge of the inside of the second section 61, the selvage edge of the non-woven aramid lining 63, the selvage edge of the woven aramid lining 65, the woven aramid lining 43, the non-woven aramid lining 47 and the inside of the second section 38.

Figure 20:
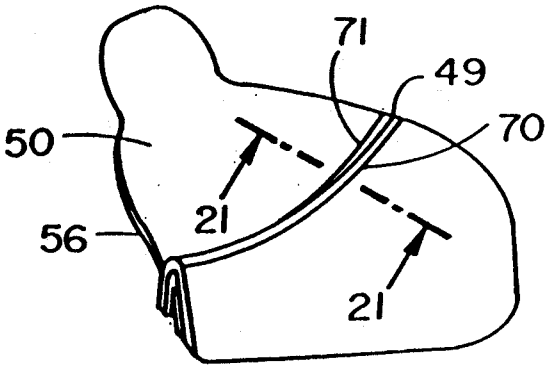
FIG. 20 is a perspective view of the protective cover of FIG. 18 showing the respective inside second section sewn together with the respective outside second section.
Figure 21:
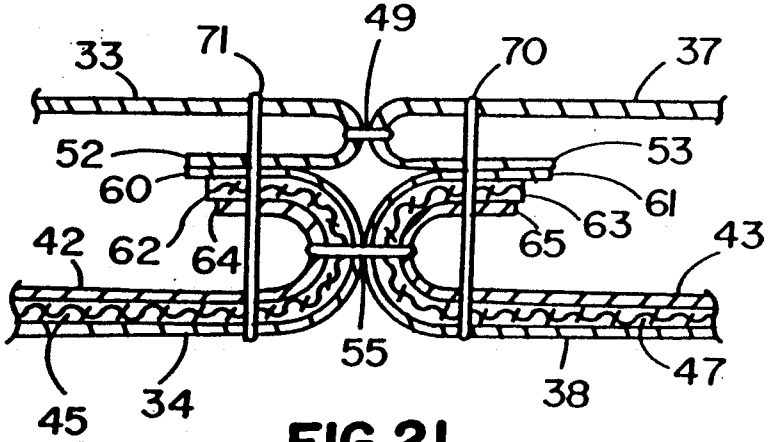
FIG. 21 is a cross-sectional view, enlarged for the sake of clarity, taken across the lines 21—21 of FIG. 20.

Referring to FIGS. 20 and 21, the outside of the first section 33 of the first portion 50 is sewn to the inside of the first section 34 of the second portion 56 by forming a seam 71 substantially parallel to, and adjacent to, the seams 49, 55 which form the respective first portion 50 and second portion 56. In this manner, the seam 71 between the outside of the first section 33 (on the first portion 50) and the inside of the first section 34 (on the second portion 56) intercepts, in sequence, the outside of the first section 33, the selvage edge of the outside of the first section 52, the selvage edge of the inside of the first section 60, the selvage edge of the non-woven aramid lining 62, the selvage edge of the woven aramid lining 64, the woven aramid lining 42, the non-woven aramid lining 45 and the inside of the first section 34.

Figure 22:
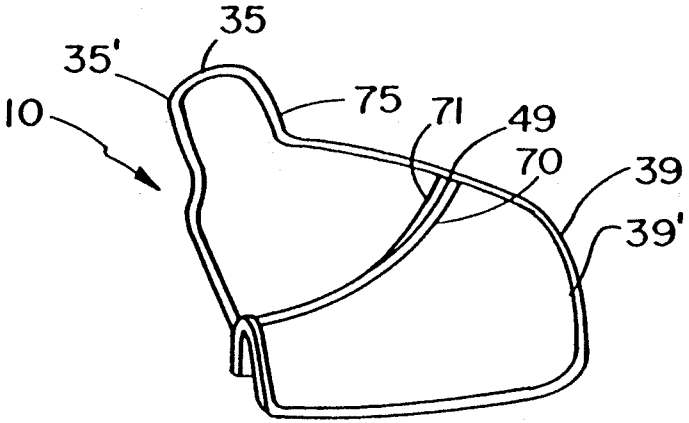
FIG. 22 is a perspective view of the protective cover of FIG. 20 showing a bias binding sewn around the protective cover.

A bias binding 75 is provided and sewn around the joined together first portion 50 and second portion 56 to overlap the tab edges 35, 35' and the back edges 39, 39' of the respective sections. (FIG. 22).

The method of sewing the inside sections 33, 37 together to have the seam 55 intercept the fabric and aramid patterns and to form selvage edges, assures that the aramid linings 43, 47, 41, 45 are butted together and there are no open spaces between the aramid linings. Thus, sharp edges, such as teeth on a chainsaw, are prevented from penetrating the sections. Further, the method of sewing the first portion 50 to the second portion 56 by having seams 70, 71 sewn substantially at right angles to the seams 49, 55 connecting the first and second sections, further assures the integrity of the cover 10. It also further assures the placement of the aramid layers to prevent penetration of sharp edges through the protective cover 10.

Figure 23:
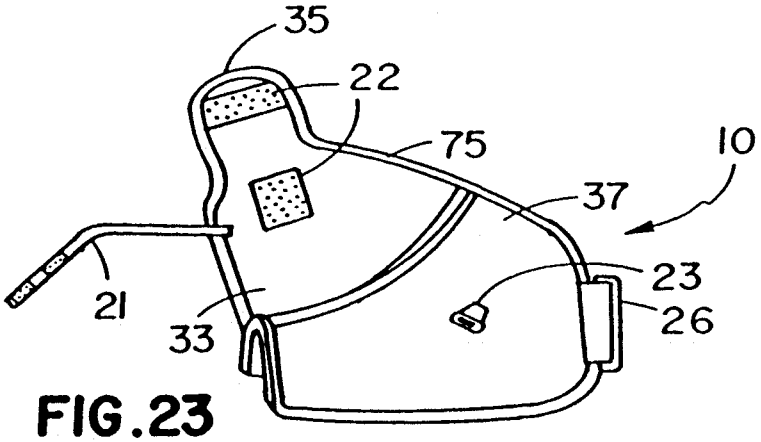
FIG. 23 is a perspective view of the protective cover of FIG. 22 showing the addition of the strap, eyelet, hook and loop fasteners and rigid loop.

As shown in FIG. 23 a strap 21 is provided having a one end and an other end. The one end of the strap 21 is attached to the outside of the first section 33 on the first portion of the shoe cover 10. A means 23 is provided for removably attaching the other end of the strap 21 to the outside of the second section 37 on the first portion of the shoe cover 10. In a preferred embodiment, the means is an eyelet 23 attached to the outside 37 of the second section through which the other end of the strap 21 may be drawn and secured. It would be apparent to one skilled in the art to use a buckle attached to outside 37 of the second section or hook and loop fasteners on the strap and on the cover 10 as means for attaching the strap.

Also shown in FIG. 23 are hook and loop fasteners 22 attached near the tab edge 35 of the outside 33 of the first section. These fasteners 22 engage the tab edge 35 after it is inserted through a rigid loop 26 secured to the second section, and folded back onto the outside section. This embodiment is used to secure the back opening 18 of the cover 10 around the shoe. It would be apparent to persons skilled in the art to use a buckle, a strap, or other means to secure the back opening 18. The design may omit the tab edge 35 and the rigid loop 26.

In an alternate embodiment, the lining between the first portion 50 and the second portion 56 is a plurality of alternating woven aramid linings and non-woven aramid linings. The seam 55 would intercept all of these linings in addition to the inside of the first section 34 and the inside of the second section 38. Further, the seams 70 and 71 would intercept the selvage edges of each respective lining.

The figures show a pattern for the right foot. In order to make a cover for the left foot, the pattern as shown would be cut as a mirror image of those shown as is well known to those skilled in the art. The method of sewing the patterns and the linings are the same as shown in the figures. The means for attaching the strap 21 and the closure means for the opening of the back 11 of the cover would be the same as with the right foot but would be fabricated accordingly.

Thus, the present invention discloses an effective protective cover for the feet and ankles of persons using chainsaws and other high speed cutting equipment. A flexible fabric covering is provided which is easily and rapidly attached over the shoe/boot of the person and can be adapted to fit a wide variety of shoe sizes. The cover is easily fabricated without the need of special equipment.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A flexible protective cover to protect feet, shoes or boots having an arch, a back, a sole, a heel, an outer side, an inner side and an instep, the protective cover comprising:

a multiple layer fabric body which, when folded, is contoured as a curve to conform to the instep of the shoe and extend to the ankle, the folded body extending from the instep of the shoe, on both the outer side and the inner side of the shoe, downwardly to the sole of the shoe and backwardly to the back of the shoe;

releasable means for securing the folded body around the arch of the shoe;

the multiple layer fabric body, when folded, further having a first side and a second side, each side having a respective upper portion and a respective lower portion, the upper portion of each side curving downwardly toward the back of the shoe, the lower portion of each side curving upwardly toward the back of the shoe; a tab extending outwardly from the first side of the fabric body beyond the back of the shoe, the tab extending substantially continuously from the upwardly curved portions to the downwardly curved portions of the sides of the body; means for connecting the tab to the second side of the fabric body around the back of the shoe and folding the tab back to connect the tab to the first side of the fabric body such that the folded body is secured around the back of the shoe.

2. The flexible protective cover of claim 1, wherein the tab has a side having hook or loop fasteners thereon, the first side of the fabric body having hook or loop fasteners thereon adjacent to the tab, the second side of the fabric body having a rigid loop means attached thereto such that the tab may be extended across the back of the shoe, the tab inserted through the rigid loop means, the tab returned to the first side of the fabric body and the hook and loop fasteners engaged, thereby releasably securing the fabric body of the cover around the back of the shoe.

3. A flexible protective cover to protect feet, shoes or boots having an arch, a back, a sole, a heel, an outer side, an inner side and an instep, the protective cover comprising:

a multiple layer fabric body which is substantially flat and, when folded, is contoured as a curve to conform to the instep of the shoe and extend to the ankle, the folded body extending from the instep of the shoe, on both the outer side and the inner side of the shoe, downwardly to the sole of the shoe and backwardly to the back of the shoe;

releasable means for securing the multiple-layer folded fabric body around the arch of the shoe;

the multiple layer fabric comprising at least a first, outer layer and a second, inner layer having an aramid lining therebetween, the aramid lining further having at least a woven fabric first layer and at least a non-woven fabric adjacent second layer such that the cover is lightweight and pliable and may be worn comfortably for extended periods and when so used, is cut and abrasion resistant, the multiple layer fabric body, when folded, having a front and a rear, further having a first side on the outer side of the shoe and a second side on the inner side of the shoe, each side having a respective upper portion and a respective lower portion, the upper portion of each side curving downwardly toward the rear of the body, the lower portion of each side curving upwardly towards the rear of the body; a tab extending outwardly from the first side of the fabric body beyond the back of the shoe, the tab extending substantially continuously from the upwardly curved portions to the downwardly curved portions of the sides of the body, the second side of fabric body having a loop means attached thereto wherein the tab may be extended across the back of the shoe, the tab inserted through the loop means, the tab pulled through the loop means and folded back substantially 180° to accommodate the protective cover to the size of the shoe; means for connecting the tab to first side of the cover to secure the folded body around the back of the shoe; thereby providing a releasable means for securing the multiple-layer folded fabric body around the back of the shoe, and thereby providing a secure mounting of the multiple-layer folded fabric body to the shoe and precluding an undesirable separation therebetween upon initial contact with a chainsaw.

4. The flexible protective cover of claim 3, wherein the multiple layer fabric body comprises at least a first portion and a second portion joined together.

5. The flexible protective cover of claim 4, wherein the first portion and the second portion are sewed together.

6. The flexible protective cover of claim 1, wherein the means for securing the folded body around the arch of the shoe comprise a strap connected to the first side of the fabric body, the strap having an end extending around the arch of the shoe and means for releasably attaching the end of the strap to the second side of the fabric body such that the folded body is secured around the arch of the shoe.

7. The flexible protective cover of claim 6, wherein the means for releasably attaching the end of the strap to the second side of the fabric body comprises hook and loop fasteners.

8. The flexible protective cover of claim 6, wherein the means for releasably attaching the end of the strap is a buckle connected to the fabric body.

9. The protective cover of claim 1, wherein the means for connecting the tab to the first side of the cover comprises hook or loop fasteners on the tab and cooperating hook or loop fasteners on the first side of the cover.

10. A protective cover for the foot of a person, wherein the foot is covered by shoes or boots having an instep, an arch, and a back portion, the protective cover having first and second sections which are substantially identical to one another, each of the sections being substantially flat and having a lower edge, a rearward edge, a forward curved edge that is concave, the first and second sections being joined together at their respective forward curved edges, the cover, when laid out, forming a substantially flat body having a upwardly projecting portion, the first and second sections being substantially flexible so that the cover may be easily and conveniently wrapped around the person's foot, such that the respective forward curved edges which are joined together will substantially conform to the instep of the person's shoe, and cover the ankle of the person, first fastening means carried by the cooperative lower edges of the first and second sections, respectively, for detachably securing the first and second sections together around the arch of the person's foot, the lower edges of the first and second sections curving upwardly toward the rearward edge of each respective section, a tab extending outwardly from the rearward edge of the first section, a loop means attached to rearward edge of the second section such that the tab may be received in the loop means and folded back approximately 180° about the loop means, means for detachably connecting the tab to the first section for securely attaching the first and second sections together around the back of the person's foot, such that the cover may be adjusted to fit the person's foot comfortably and the cover does not interfere with the person's tasks, each of the sections having a multiple ply construction including an outer layer, an inner layer, and a layer of an aramid lining secured between the inner and outer layers, the inner and outer layers being substantially tough and abrasion resistant, and the aramid lining having at least a woven fabric first layer and at least a non-woven fabric adjacent second layer, the aramid lining being fully capable of stopping a chainsaw in the event the outer layer is cut by the saw.

11. A flexible protective cover to protect feet, shoes or boots having an arch, a toe, a back, a sole, an outer side, an inner side and an instep, the protective cover comprising a multiple layer fabric body which, when laid out, is substantially flat having an upwardly projecting portion and, when folded, is contoured as a curve to conform to the instep of the shoe and extend to the ankle, the upwardly projecting portion conforming to the toe of the shoe, the folded body extending from the instep of the shoe, on both the outer side and the inner side of the shoe, downwardly to the sole of the shoe and backwardly to the back of the shoe, wherein the cover may fit a wide variety of shoe sizes; releasable means for securing the folded body around the arch of the shoe; the multiple layer fabric body, when folded, further having a first side and a second side, each side having a respective upper portion and a respective lower portion the upper portion of each side curving downwardly toward the back of the shoe, the lower portion of each side curving upwardly toward the back of the shoe; a tab extending outwardly from the first side of the fabric body beyond the back of the shoe, the tab extending substantially continuously from the upwardly curving portions to the downwardly curving portions of the sides of the body; means for releasably connecting the tab to the second side of the fabric body around the back of the shoe, such that the folded body is secured around the back of the shoe; and the multiple layer fabric comprising at least a first outer layer, a second inner layer, and an aramid lining therebetween, such that the cover is lightweight and pliable and may be worn comfortably for extended periods, and such that the cover is cut and abrasion resistant.

12. The flexible protective cover of claim 11, wherein the tab has a side having hook or loop fasteners thereon, the first side of the fabric body having hook or loop fasteners thereon adjacent to the tab, the second side of the fabric body having a loop means attached thereto such that the tab may be extended across the back of the shoe, the tab being inserted through the loop means, the tab being returned to the first side of the fabric body and the respective hook and loop fasteners being engaged, thereby releasably and adjustably securing the fabric body of the cover around the back of the shoe.

13. A removable cover intended to protect the foot of a person, particularly when the person is using a chainsaw to cut timber, the cover being wrapped around the shoe on the person's foot and being substantially universal for a variety of shoe sizes, wherein the shoe includes a toe portion, an instep, a sole, side portions joining the instep and sole, respectively, and a back portion, the cover comprising a flexible multi-layer unitary member including an aramid lining to grab the chainsaw and substantially bind the same in the event the chainsaw is accidentally brought into contact with the cover and cuts into the cover, the cover further comprising a substantially-flat member having a central forwardly-disposed upwardly projecting portion slipped over the toe portion and instep of the shoe, the shoe being received within the cover as the cover is wrapped around the shoe, the cover having respective side portions including a left side portion and a right side portion, each side having a respective upper portion and a respective lower portion, the upper portion of each side curving downwardly toward the back portion of the shoe, the lower portion of each side curving upwardly toward the back portion of the shoe, one of the side portions having a rearwardly-extending tab formed thereon, the tab extending substantially continuously from the upward curving portion to the downwardly curving portion of the side portions of the cover, the other side portion having a loop means thereon through which the tab is received, the tab being grasped and pulled through and around the loop means to tighten the cover on the shoe, first quick-release fastening means between the tab the and one side portion of the cover to secure the cover to the shoe longitudinally thereof, a strap carried by one of the side portions of the cover and extending downwardly therefrom substantially from the instep to the sole of the shoe, and second quick-release fastening means between the strap and the other of the side portions of the cover, thereby further securing the cover to the shoe transversely thereof.

14. A flexible protective cover for protection of feet, shoes or boots having an arch, a back, a sole, an other side, an inner side and an instep, the protective cover comprising:

a multiple layer fabric body which is substantially flat and, when folded, is contoured as a curve to conform to the instep of the shoe and extend to the ankle, the folded body extending from the instep of the shoe, both on the outer side and the inner side of the shoe, downwardly to the sole of the shoe and backwardly to the back of the shoe;

releasable means for securing the folded body around the arch of the shoe;

releasable means for securing the folded body around the back of the shoe; and the multiple layer fabric comprising at least a first, outer layer and a second, inner layer having an aramid lining therebetween, the aramid lining further having at least a woven fabric first layer and at least a non-woven fabric adjacent second layer such that the cover is lightweight and pliable and may be worn comfortably for extended periods and when so used, is cut and abrasion resistant; wherein the multiple layer fabric body comprises at least a first portion and a second portion joined together; the multiple layer fabric body when folded, further having a first side on the outer side of the shoe, and a second side on the inner side of the shoe each side having a respective upper portion and a respective lower portion, the upper portion of each side curving downwardly toward the back of the shoe, the lower portion of each side curving upwardly toward the back of the shoe; means for securing the folded body around the arch of the shoe comprising a strap connected to the first side of the fabric body, the strap having an end extending around the arch of the shoe and means for releasably attaching the end of the strap to the second side of the fabric body such that the folded body is secured around the arch of the shoe; a tab extending outwardly from the first side of the fabric body beyond the back of the shoe, the tab extending substantially continuously from the upwardly curved portions to the downwardly curved portions of the sides of the body; means for connecting the tab to the second side of the fabric body around the back of the shoe such that the folded body is secured around the back of the shoe.

15. A protective gaiter for the operator of a chainsaw, the gaiter being removably attached to the operator's shoe or boot and comprising a substantially-flexible unitary article including an aramid lining intended to substantially retard the chainsaw in the event the chainsaw inadvertently comes into contact with the operator's shoe or boot and, in particular, to front or side thereof, thereby protecting the operator against a very serious injury, the gaiter having a front and a rear and further including a pair of side sections integrally joined together at the front thereof, thereby forming an opening at the rear, such that the gaiter may be disposed over the shoe or boot, each of the side sections of the gaiter having an upper portion and a lower portion, means for removably securing the lower portion of each side section to the operator's shoe or boot, the upper portion of each side section of the gaiter curving downwardly towards the rear of the shoe or boot, the lower portion of each side section of the gaiter curving upwardly towards the rear of the shoe or boot, such that when the gaiter is attached to the operator's shoe or boot, the gaiter will not substantially impede nor interfere with the operator's normal movements in walking, one of the side sections of the gaiter having a tab integrally joined thereto and extending rearwardly thereof, the tab having a vertical height which is substantially equal to the vertical height of the rear of the gaiter between the upwardly and downwardly curved portions of the respective side sections of the gaiter, the other side section of the gaiter having a loop secured thereto, such that when the gaiter is attached to the operator's shoe or boot, the tab is inserted into the loop and the tab is pulled therethrough and folded back on itself towards the one side section of the gaiter, and detachable fastening means between the tab and the one side section of the gaiter, thereby providing a secure detachable mounting of the gaiter to the operator's shoe or boot and precluding an undesirable separation therebetween upon the initial inadvertent or accidental contact between the chainsaw and the front or side sections of the gaiter.

16. The protective gaiter of claim 15, wherein the aramid lining comprises at least a woven aramid fabric first layer and at least a non-woven aramid fabric adjacent second layer.

17. The protective gaiter of claim 15, wherein the operator's shoe or boot has an arch, and wherein the means for removably securing the lower portions of the respective side sections of the gaiter to the operator's shoe or boot, comprises a strap means attached to the lower portion of one side section, the strap having an end extending around the arch of the operator's shoe or boot, and means for releasably attaching the end of the strap to the other side section of the gaiter.

* * * * *